United States Patent [19]

Feuz

[11] Patent Number: 5,031,661

[45] Date of Patent: Jul. 16, 1991

[54] DOUBLE CHECK VALVE BACKFLOW PREVENTER ASSEMBLY

[75] Inventor: John G. Feuz, Portland, Oreg.

[73] Assignee: Buckner, Inc., Fresno, Calif.

[21] Appl. No.: 464,149

[22] Filed: Jan. 12, 1990

Related U.S. Application Data

[62] Division of Ser. No. 216,857, Jul. 8, 1988; Pat. No. 4,893,654.

[51] Int. Cl.[5] ..... F16K 27/00

[52] U.S. Cl. ..... 137/614.2; 137/613

[58] Field of Search ..... 137/315, 327, 328, 454.6, 137/512, 614.2, 614.21, 613

[56] References Cited

U.S. PATENT DOCUMENTS 1,621,712 3/1927 Dawson ..... 137/613 X
4,284,097 8/1981 Becher et al. ..... 137/512 X

FOREIGN PATENT DOCUMENTS 74468 3/1917 Fed. Rep. of Germany ... 137/614.2

OTHER PUBLICATIONS

Hersey Products, Inc. brochure entitled "Double Check Valve Ass'y", Seeham, Mass. 1980.

*Hydraulics and Pneumatics,* vol. 16, No. 11, Nov. '63, pp. 88 & 89, Article entitled "What you can get in manifolds."

*Primary Examiner*—John C. Fox

*Attorney, Agent, or Firm*—Klarquist, Sparkman, Campbell, Leigh & Whinston

[57] ABSTRACT

A backflow preventer assembly for a liquid supply line includes a single unitary valve body including flanged inlet and outlet end openings and a single access opening generally normal to the flow path defined by the inlet and outlet openings. The body houses a pair of check valve seats on opposite sides of the access opening for seating a pair of check valves mounted in series to permit flow from the inlet opening to the outlet opening. Adjustable compression rods interconnecting the two check valves seat the valves against their oppositely facing valve seats. The check valves and compression rods are sized to enable installation and removal of the valves through the access opening. In one embodiment the valve body has a predetermined length for installation in the liquid supply line between a pair of gate valve assemblies, such length being the same as a standard body length for a signel check valve assembly. In a second embodiment, the single unitary body incorporates, in addition to check valve assemblies, a pair of gate valve housings one on each of the opposite sides of the gate valve assemblies so that the single body can incorporate, as a unit, the complete backflow preventer assembly including gate valves and double check valves.

9 Claims, 3 Drawing Sheets

DOUBLE CHECK VALVE BACKFLOW PREVENTER ASSEMBLY

This is a division of application Ser. No. 07/216,857, filed July 8, 1988 now U.S. Pat. No. 4,893,654.

FIELD OF THE INVENTION

The present invention relates to a backflow preventer valve assembly for a liquid supply line. Such assemblies are commonly used in buildings equipped with sprinkler systems to prevent backflow from the sprinkler head supply lines to the potable water supply line. More particularly, the invention relates to a double check valve backflow preventer assembly.

BACKGROUND OF THE INVENTION

Backflow preventers are valve assemblies that have long been used to prevent a pure, safe drinking water source to become contaminated with liquids from undesirable sources through cross connection of the drinking water supply system with a liquid system that might be or become degraded, polluted or otherwise unsafe. Typical situations in which cross connections may present hazards to drinking water supplies include any connections of city drinking water supply systems to process water systems of industrial buildings, steam boilers, pressure steam cookers, irrigation systems, and fire protection systems. City and county building codes and other government regulations typically require the use of a backflow preventer whenever such cross connections are present.

In the past, typical backflow preventers have consisted of a single spring-loaded check valve in the water supply line, perhaps between a pair of gate-type shutoff valves. However, modern building codes now require backflow preventers to include a pair of independently spring-loaded positive check valves connected in tandem between a pair of shutoff valves. One such check valve serves as a backup in case the other should fail. Modern codes also typically require that the check valves be replaceable and repairable while in-line, that is, without shutting down the system. To complicate matters, many building codes now require the upgrading of older buildings to include sprinkler systems This in turn necessitates the installation of backflow preventers in the fire protection system water lines to such buildings to prevent backflow into city water supply lines.

Codes that require the replacement of single check valves with double check valve backflow preventers have necessitated building owners to undertake major replumbing. The existing single check, valve and its associated gate valves must be removed, and the supply line cut to provide space to accommodate a pair of single check valve assemblies connected in series between a pair of gate valves. This involves the installation of four separate valve assemblies and their interconnection to each other. Moreover, separate access for repair and replacement must be provided in the valve housings for each separate check valve assembly.

Even in new construction, although not requiring expensive replacement of existing lines, installation of double check valve preventers is difficult. The double check valve backflow preventers when assembled are large, long and cumbersome. Installation involves interconnecting a first gate valve assembly, a pair of separate check valve assemblies, and a second gate valve assembly, and the connection of the opposite ends of that assembly to the water service line.

A typical single check valve assembly is the Ames Model DCV shown in a brochure published by Ames Company, Inc. of Woodland, Calif. A typical double check valve backflow preventer is the Ames Company Model DC shown in the same brochure. The spacing between the gate valves must be twice as great when a double check valve backflow preventer of the aforementioned Ames type is used instead of a single check valve, thereby requiring the aforementioned substantial replumbing when a double check preventer must replace a single check valve. Other, similiar types of double check valve backflow preventers are illustrated in a brochure published by Cla-Val Co., Backflow Preventer Division, of Newport Beach, Calif. They are designated as Models RP-1, D, 27 and 16. Still another double check valve backflow preventer assembly is shown in a brochure published by Febco Division of Johns-Manville Company, designated as the Model 805.

It has been suggested that the two check valve assemblies of a double check valve backflow preventer can be combined in a single unitary valve body for connection between a pair of gate valves, as shown for example in a two-page advertising brochure published by Hersey Products, Inc., Water Meter & Controls Group of Dedham, Mass. such assembly being designated the Hersey No. 2. The aforementioned Febco, Cla-Val and Ames companies have also produced double check valve backflow preventer assemblies incorporated in a single valve body. See, for example, the ¾-2 inch size of the Model 805 Febco, the Models RP-2 and D-2 of Cla-Val, and the Model RP of Ames, all as shown in the aforementioned advertising materials. None of the indicated double check backflow preventers combined in a single valve body reduce to any substantial extent the overall length of the body as compared to such valves in which each check valve is housed in its own separate body. Furthermore, all such double check preventers require a separate access opening for each check valve. Thus, known double check preventers housed in a single valve body are substantially as long and cumbersome, and as difficult to install, access and service, as such preventers in which each check valve is housed in its own separate valve body. In addition, existing double check preventers housed in a single valve body still require connections to separate gate valve housings at either end of the assembly In effect, existing double check preventers housed in a single valve body have most of the disadvantages of such preventers housed in separate valve bodies.

Accordingly, there is a need for a double check valve backflow preventer assembly which can be retrofitted into an existing liquid supply line to replace a single check valve without having to remove the gate valves at either end of the assembly and portions of the supply line to accommodate the double check preventer assembly. There is also a need for a double check backflow preventer assembly which incorporates gate valve housings as part of the assembly within a single valve body. Finally, there is a need for a double check preventer which provides easy in-line access to both check valves for repair or replacement when needed.

SUMMARY OF THE INVENTION

The invention comprises a double check valve backflow preventer assembly housed within a single unitary valve body and having the same length as the body of a standard single check valve. This enables the double check preventer assembly to be retrofitted in systems formerly having single check valves simply by removing the single check valve assembly and replacing it with a double check preventer assembly of the present invention.

According to one form of the invention, the single unitary valve body is adapted for connection at its opposite ends to separate gate valve assemblies. According to another form of the invention, the single unitary valve body may incorporate as part thereof a pair of gate valve housings one at either end of the body, so that the two gate valves and intermediate check valves are incorporated in a single unitary valve body.

The single unitary valve body of the invention may incorporate a single access opening for accessing both check valves and their respective valve seats.

According to another aspect of the invention, the valve body may include a pair of annular check valve seats positioned on opposite sides of a single access opening for easy access. The seats may include annular seat surfaces in planes normal to the flowpath through the body, with such surfaces of the different seats facing one another on opposite sides of the access opening so that the two check valves can be easily seated within the single body from the same access opening.

According to another aspect of the invention, the check valve assemblies may be seated against their respective valve seats using common compression means extending between the two valve assemblies and accessible through a single access opening in the valve body.

According to still another aspect of the invention, the two check valve assemblies are sized so as to be easily installed within and removed from the single valve body through a single access opening without disassembling such assemblies.

Each check valve may include a stationary cage member and a movable cup-like closure member, with the cage member including a cage ring for seating against a valve seat, a central cage cylinder connected to the ring through cage arms, a cage piston movable within the cylinder and a piston rod connected to the piston at one end of the cylinder, extending through the opposite end of the cylinder and connected to the closure member. A spring means within the cylinder urges the piston toward one end of the cylinder and the closure member toward a closed position against the cage ring. Pressure surfaces on the closure member respond to small pressure differentials across the closure member when in its closed position to cause the member to open and allow flow from the inlet end to the outlet end of the valve body. The member closes under positive spring pressure in the absence of a pressure differential or when back pressure exceeds upstream pressure to prevent backflow through the valve body.

Primary objectives of the present invention are to provide a double check valve backflow preventer assembly which:

1. is shorter than prior such assemblies and which can be made in the standard length of single check valve assembly, thereby enabling replacement of single valve assemblies with double check preventers with minimum time, labor, cost and changes to the liquid supply line;
2. enables repair and replacement of the check valves and their components in-line and through a single access opening;
3. is housed in a single unitary valve body;
4. incorporates a pair of check valve seats cooperable to seat both check valves using the same compression means;
5. incorporates an improved and simplified means for seating and removing the check valves from the valve body;
6. may incorporate in a single unitary valve body both check valves and a pair of gate valves;
7. is easier to make, install and service than prior such preventers and has a wide variety of applications in backflow prevention.

The foregoing and other objects, features and advantages of the present invention will become more apparent from the following detailed description which proceeds with reference to the accompanying drawings.

DETAILED DESCRIPTION OF A PREFERRED EMBODIMENT

Figure 1:
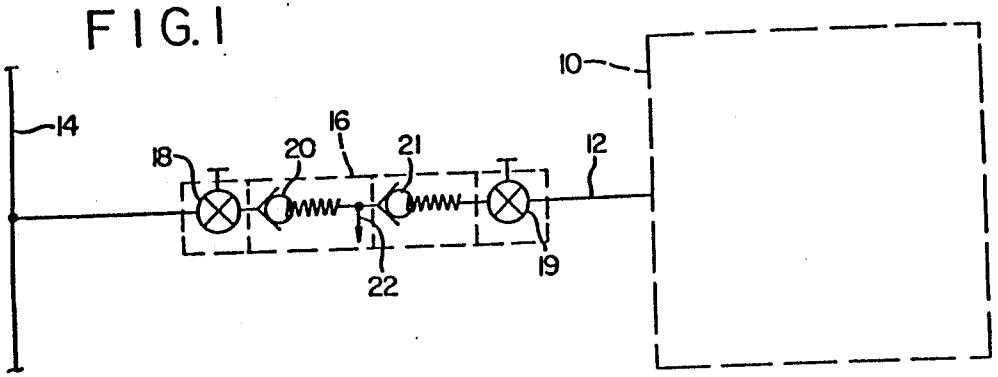
FIG. 1 is a diagram of a water system illustrating a typical application for a double check valve backflow preventer assembly.
Figure 6:
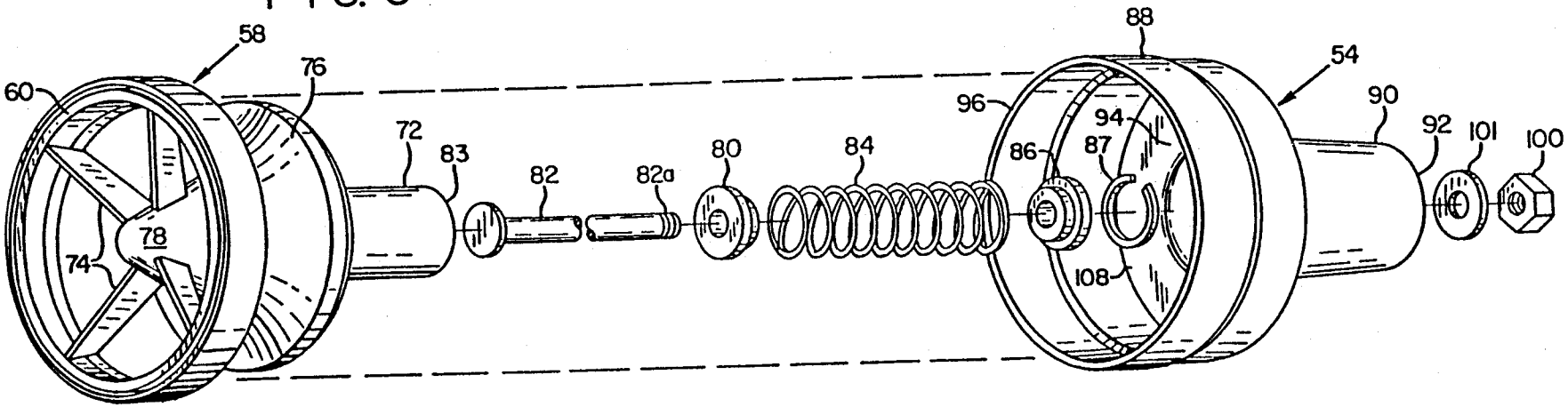
FIG. 6 is an exploded perspective view of one of the check valves shown in FIGS. 2 and 3.

FIG. 1 represents a typical application for a double check valve backflow preventer assembly in which a high-rise building 10 has a sprinkler system (not shown) supplied with water through a sprinkler water supply line 12 from the potable water supply main 14 of a city water supply system. To prevent the backflow of degraded water from supply line 12 of the fire protection system backflowing into and thus possibly contaminating the drinking water supply in main 14, the double check valve backflow preventer assembly 16 is inserted in line 12.

The preventer assembly includes a pair of gate-type shutoff valves 18, 19 connected in series on opposite sides of a pair of positive check valves 20, 21. Each check valves typically is spring-loaded in a direction to prevent backflow of water from supply line 12 to main 14 but permit flow of water under normal water system pressure through the check valves and into the distribution lines (not shown) of the sprinkler system within building 10 under normal system operating pressures. Typically the check valves 20 and 21 are designed to open and permit flow in the normal downstream direction through the valves when the differential pressure across the check valves exceeds one psi.

Typically also, each of gate valves 18, 19 and check valves 20, 21 is housed within a separate valve body and then the four bodies are coupled together into supply line 12 through standard flanged connections to form the double check valve backflow preventer assembly shown. The assembly may also incorporate a well known back pressure relief valve 22 to relieve excess back pressure between the check valves.

FIG. 2 Embodiment

Figure 2:
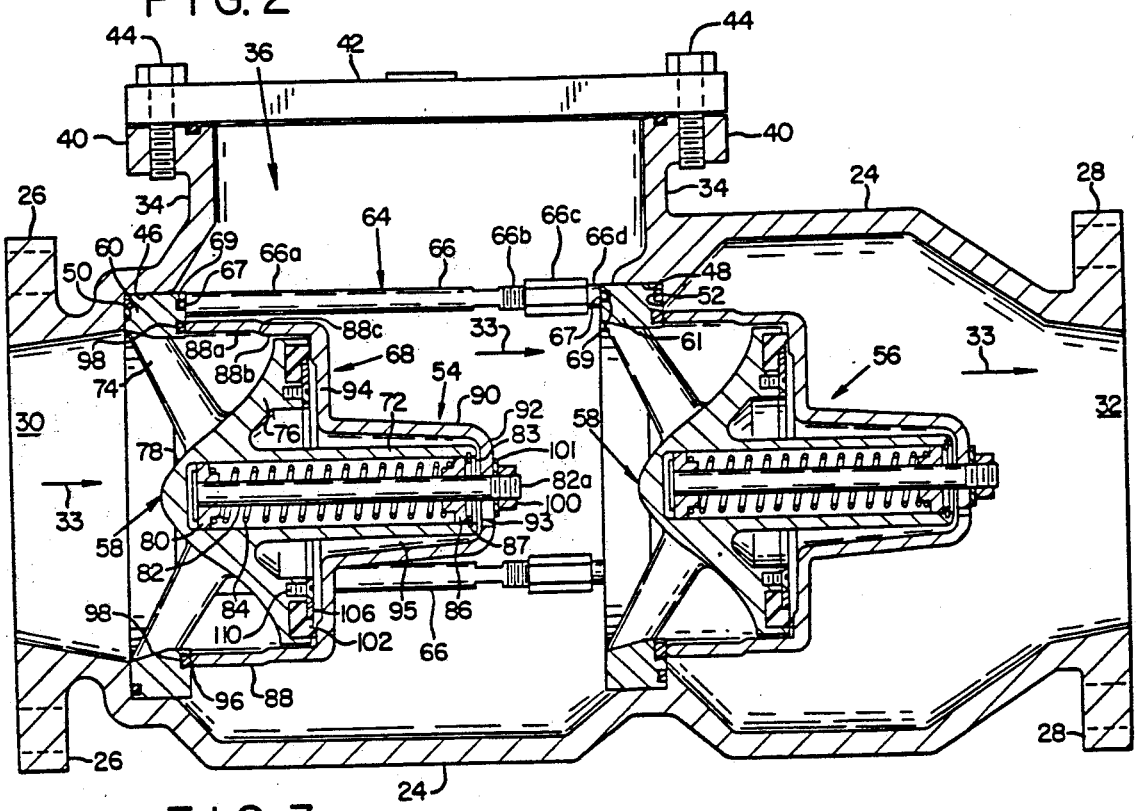
FIG. 2 is an axial sectional view of a double check valve backflow preventer assembly in accordance with the invention.
Figure 3:
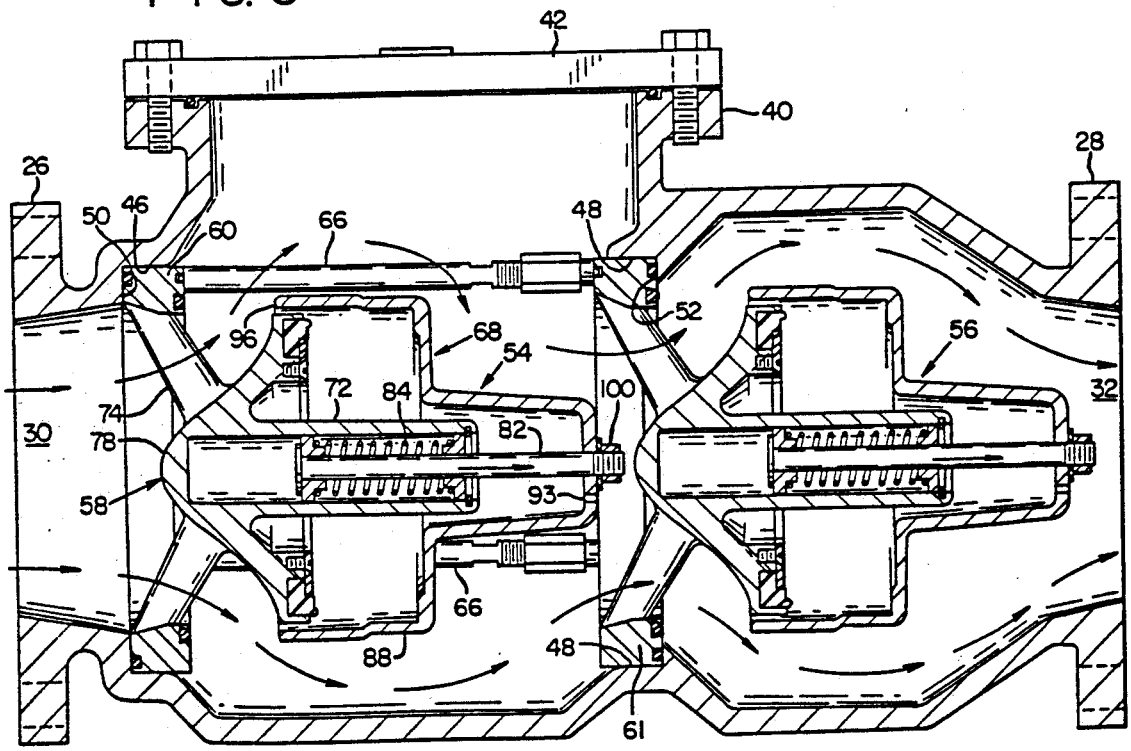
FIG. 3 is a view similar to that of FIG. 2 but showing the check valves of the assembly in their open positions.

With reference now to FIGS. 2 and 3, a double check valve backflow preventer assembly in accordance with the invention includes a single unitary valve body 24 having opposite end connector flanges 26, 28 defining inlet 30 and outlet 32 end openings. The generally cylindrical body 24 defines a generally straight flow path or passage 33 through the body from the inlet end opening to the outlet end opening. Between its opposite ends and closer to the inlet end, the valve body defines an upwardly extending annular wall 34 defining an access opening or port 36 extending into the valve body generally normal to flow path 33. Access port wall 34 terminates at its upper end in an annular connecting flange 40 for receiving an access cover 42 secured to the access port flange 40 by screws 44.

The interior wall surfaces of the valve body define a pair of annular check valve seats including a first annular valve seat 46 and a second annular valve seat 48 on opposite sides of access opening 36. First valve seat 46 includes an annular valve seat surface 50 in a plane generally normal to flow path 33 and facing in the downstream direction of the valve body. The second valve seat 48 also includes an annular valve seat surface 52 lying in a plane generally normal to flow path 33 but facing in an upstream direction relative to normal flow through the valve body. Thus first annular seat surface 50 and second annular seat surface 52 face each other on opposite sides of access opening 36, the importance of which will soon be apparent. Both valve seats 46 and 48 are closely adjacent the access opening for ease of access through such opening, the importance of which will also soon be apparent.

A pair of check valve assemblies seated within the valve body includes a first check valve assembly 54 seated against first valve seat 46 and a second check valve assembly 56 seated against second valve seat 48. Both check valve assemblies are identical in size and construction and therefore the following description of valve assembly 54 applies to both assemblies. Each includes an annular cage ring as part of a stationary cage member 58, the cage ring of first valve assembly 54 being designated 60 and the cage ring of second check valve assembly 56 being designated 61.

Cage ring 60 of the first check valve is seated in fluid sealing engagement with first valve seat 46, and cage ring 61 is seated in fluid sealing engagement with second valve seat 48. Seating means 64 common to both check valves compresses cage rings 60, 61 against their respective annular valve seat surfaces 50, 52 to seat check valve assemblies 54, 56 against their respective valve seats 46, 48. Seating means 64 includes at least three rigid but adjustable-length compression rods 66 extending between and interconnecting the two cage rings 60, 61 at equally spaced locations about the cage rings. Each compression rod includes a primary rod section 66*a*, a threaded rod section 66*b* threaded into one end of an adjustment nut 66*c*, and a short rod section 66*d* extending from the opposite end of nut 66*c*. The free ends of sections 66*a* and 66*d* include nipples 67 received within recesses 69 of rings 60, 61.

By rotating nut 66*c* in opposite directions, the effective length of rod 66 can be increased or decreased to vary the compressive force exerted at its opposite ends against cage rings 60, 61 to compress such rings against their respective valve seat surfaces 50, 52 to hold the check valves in their seated positions. By effectively shortening the lengths of the compression rod 66, the rods can be removed from their engagement with the cage rings and can be withdrawn through access opening 36. With the access rods removed from the valve body, the check valve assemblies 54, 56 can also be removed, first by removing valve assembly 54 through access opening 36 and then by removing check valve assembly 56 through the same opening. Both check valve assemblies are small enough to be removed intact through access opening 36. The unique construction of the check valve assemblies which enables their compact size to permit this, is described below.

Each check valve assembly 54, 56 is mounted against its corresponding valve seat to open in the downstream direction of flow through the valve body from inlet opening 30 to outlet opening 32 when fluid pressure upstream of each valve exceeds fluid pressure downstream thereof by a small amount; for example, one psi. Each check valve assembly includes, in addition to stationary cage member 58, a movable valve closure member 68. The valve closure members 68 of the two check valves 54, 56 are shown in their closed positions in FIG. 2 and in their open positions in FIG. 3, the latter positions permitting the flow of liquid through the valves from inlet end opening 30 to outlet end opening 32. A drop in upstream pressure or an increase in back pressure in the supply line downstream of the valves immediately causes the check valves to return to their closed positions shown in FIG. 2, thereby preventing backflow through the valve body.

Figures 5, 7:
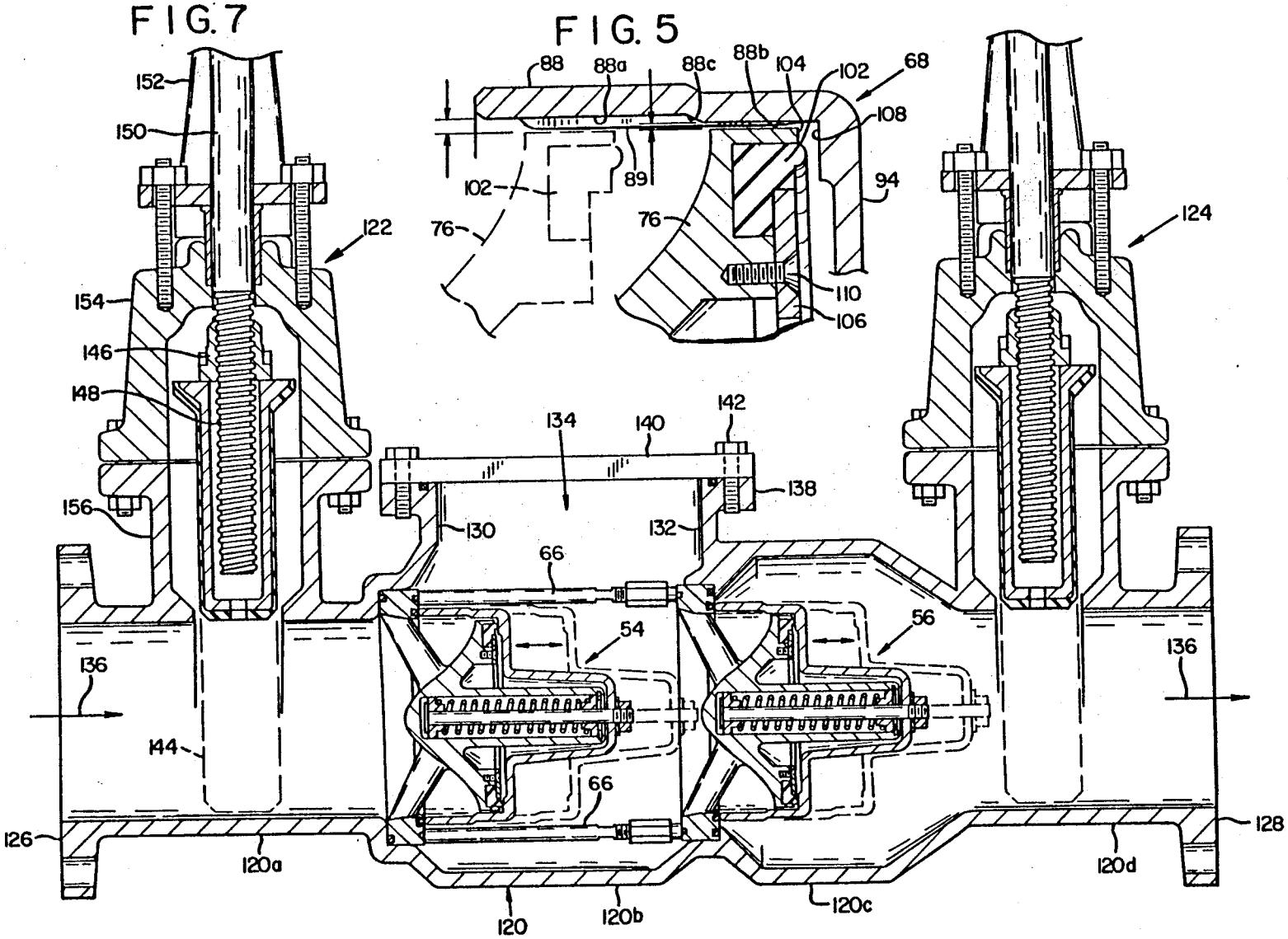
FIG. 5 is an enlarged partial sectional view of a wall portion of the closure member of one of the check valves shown in FIGS. 2 and 3.
FIG. 7 is an axial sectional view of a modified form of double check valve backflow preventer assembly in accordance with the invention.

Referring especially to FIGS. 2, 3 & 5, cage member 58 includes, in addition to its peripheral ring 60 or 61, a central cage cylinder 72 connected to the peripheral ring 60 or 61 by radial arms 74. A guide member or disc 76 extends generally radially and slightly rearwardly (downstream) from a hub portion 78 at the forward or upstream end of cylinder 72. A piston 80 is movable within the cylinder from its upstream end 78, and a connected piston rod 82 extends from the piston through an opposite end 83 of the cylinder. A coil compression spring 84 within the cylinder and surrounding the piston rod abuts piston 80 at one end and a fixed rear end wall 86 of the cylinder at the other end to urge the piston toward the upstream end 78 of the cylinder. Rear end wall 86 is formed by a bushing held in place by a snap ring 87.

Figure 4:
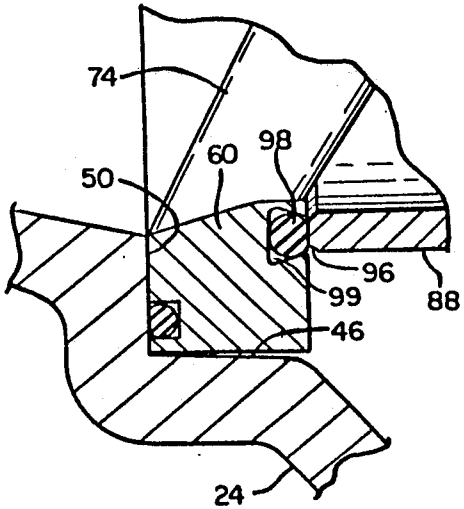
FIG. 4 is an enlarged partial sectional view of the valve seat portion of one of the check valves shown in FIGS. 2 and 3.

Valve closure member 68 is a generally cup-like member having generally cylindrical sidewall portions including a large forward cylindrical sidewall 88 and a smaller rearward sidewall portion 90 closed by a rear end wall 92. Another intermediate end wall or shoulder portion 94 closes the rearward (downstream) end of large sidewall portion 88. The opposite, upstream end of sidewall 88 terminates at an annular but stepped free end 96 which engages a resilient rubber annular sealing ring 98 of cage ring 60 or 61 in the closed position of the closure member to prevent fluid flow past the seal in either direction. As shown best in FIG. 4, annular stepped end 96 of the closure member includes a shoulder 96*a* which abuts a transverse surface 98*a* of seal 98. A longitudinal surface 96*b* of end 96 seals against a mating longitudinal surface 98*b* of seal 98. Seal ring 98 is held in an annular groove 99 of ring 60 or 61.

In the open position of closure member 68, shown in FIG. 3, liquid can flow through the gap between the annular free end 96 of such member and cage ring 60 or 61. The rear (downstream) end of piston rod 82, through a connected nut 100 and washer 101, abuts the outside of rear end wall 92 of closure member 68 so that closure spring 84 urges the closure member toward its closed position. The rear end of piston rod 82 is threaded at 82*a* to receive nut 100. Rear end wall 92 of the closure member includes a bleed hole 93 to equalize fluid pressure within a chamber 95 of the closure member and pressure downstream of the closure member when the closure member is in its closed position.

As shown best in FIGS. 2, 3 and 5, sidewall 88 of the closure member includes an inner wall surface of two different diameters, including a forward (upstream) wall surface 88*a* of relatively large diameter and a rearward (downstream) wall surface 88*b* of slightly smaller diameter and defining a slight shoulder or pressure surface portion 88*c* at the intersection of the forward and rearward wall surfaces. When closure member 68 is in its closed position shown in FIG. 2, an annular resilient seal 102 carried in an annular groove 104 in a rear surface of cage guide member 76 and held there by a retainer ring 106, sealingly engages an inner rear wall surface 108 of closure end wall 94. Retainer ring 106 is held in place by retainer screws 110.

When upstream fluid pressure (upstream of seal 102) exceeds downstream fluid pressure (downstream of seal 102 and closure member 68), the differential pressure acts against shoulder or pressure surface 88*c* and also against the portion of closure surface 108 exposed to upstream pressure, shifting the closure member downstream to its open position as shown in FIG. 3 to permit fluid flow through the valve body. Of course, the same upstream pressure differential that opens check valve 54 will also act to open the downstream or second check valve 56 after the upstream valve opens. When this happens, liquid flows relatively unimpeded through the valve body from the inlet end opening 30 to the outlet end opening 32. Both valve closure members remain in their open positions until fluid pressures on opposite sides of the valves equalize, whereupon springs 84 urge the valve closure members 68 back to their closed positions, preventing backflow through the valve body.

FIG. 7 Embodiment

FIG. 7 discloses a modified form of double check valve backflow preventer assembly which differs from the embodiment of FIG. 2 primarily in having a single unitary valve body 120 that incorporates not only the same of check valves 54, 56 as previously described, but also a pair of gate valve assemblies 122, 124, one on each of the opposite sides of the check valves 54, 56.

Valve body 120 includes a flanged inlet end 126 just upstream of upstream gate valve assembly 122 and an flanged outlet end 128 just downstream of the downstream gate valve assembly 124.

Valve body 120 may be said to include four integral subsections, beginning at the upstream end with an upstream gate valve body section 120*a*, then a first check valve body section 120*b*, a second check valve body section 120*c*, and a downstream gate valve body section 120*d*. The first gate valve body section 120*a* includes upwardly extending access wall portions 130, 132 which define an access opening 134 extending into the valve body in a direction generally normal to the flow path 136 of fluid through body 120. The access port walls 130, 132 are flanged at 138 for receiving an access cover 140 normally held in place by threaded fasteners 142 extending through the cover and threaded into the flange. When cover 140 is removed, access opening 134 provides access to both check valve assemblies 54, 56 in the manner previously described with respect to FIG. 2. That is, check valve assemblies 54, 56 are mounted within body 120 in exactly the same manner as they are mounted within the body 24 of FIG. 2.

Except for being incorporated within the single unitary valve body 120 of FIG. 7, gate valve assemblies 122, 124 are of conventional construction. For example, the gate valve assemblies 122, 124 may be of the well-known types manufactured by ITT Kennedy Valve Company of Elmira, N.Y., under the brand name "KEN-SEAL", as shown, for example, in its KEN-SEAL Resilient-Seated Gate Valve Catalog RSGV-87. In general, each such gate valve assembly includes a closure disc 144 connected to a stem nut 146. The stem nut receives a threaded portion 148 of a stem 150, which extends upwardly to a hub 152 for receiving a gate valve handle (not shown). Stem 150 extends through a central opening in a bonnet portion 154 of its body section 120*a*, the bonnet section in turn being connected by suitable fasteners (not shown) to the main valve body portion 156, which is integral with the remaining portions of the valve body section 120*a* and thus the entire unitary valve body 120. The foregoing description of gate valve assembly 122 also applies to gate valve assembly 124.

Installation and Use

The double check valve backflow preventer of FIG. 2 is sized, both in diameter and in length, to replace a single check valve body in a water supply line. That is, the single check valve body is removed from the supply line and replaced with the valve body 24 with check valves 54 and 56 preinstalled. The gate valves normally in the supply line upstream and downstream from the check valve assembly need not be removed nor replaced. The check valves 54, 56 can be serviced or replaced simply by removing access cover 42 to permit access for service or replacement through access opening 36.

The check valve assemblies 54, 56 are normally spring biased by coil springs 84 to their closed positions, but are designed to open when there is a one psi pressure differential across each valve. Of course, first the upstream valve assembly 54 will open when such a pressure differential is sensed, and then the second or downstream valve assembly 56 will open when it senses the first pressure differential. When the pressure differential is removed, both valves will immediately return to their closed positions.

The double check valve preventer assembly of FIG. 7 operates in the same manner as that of FIG. 2, except that the assembly is designed to replace a single check valve assembly and its upstream and downstream gate valves and has the same length as those separate components when joined together. The single check valve assembly and its gate valves would be removed from a supply line and replaced with the single unit of FIG. 7.

Access to check valve assemblies 54, 56 in valve body 120 is through access opening 134 after removing access cover 140. The check valve assemblies 54, 56 can be serviced or removed from valve body 120 in the same manner as such valve assemblies can be removed from the valve body of FIG. 2. However, the gate valve assemblies 122, 124 cannot be serviced or replaced from access opening 134. Instead, such valve assemblies can be serviced or replaced easily at their respective valve body sections 120*a*, 120*d*. For example, gate valve assembly 122 can be serviced by removing its bonnet 154 to provide access to the interior of the gate valve. There is also access to the gate valve disc 144 through inlet end 136, but of course this would require removal of valve body 120 from its supply line.

Having illustrated and described the principles of my invention by what is presently a preferred embodiment and a modification thereof, it should be apparent to persons skilled in the art that my invention may be modified in arrangement and detail without departing from such principles. I claim as my invention the embodiments shown and described and all modifications and variations thereof coming within the true spirit and scope of the following claims:

I claim:

1. A valve body for a backflow preventer valve assembly having a pair of check valves arranged in series to permit fluid flow in the same direction, the valve body comprising:

a single unitary body member having opposite inlet and outlet end connecting means defining flow inlet and outlet openings, said openings defining a common flow axis and said body member defining a generally straight flow path, said body member defining a single access opening between said inlet and outlet end openings, the access opening being generally normal to the flow path, and a pair of annular check valve seats, one on each of opposite sides of said access opening and both closely adjacent to said opening, each of said valve seats defining an annular seat surface in a plane generally normal to the flow path, the annular seat surface of each valve seat of said pair facing the annular seat surface of the other valve seat of the pair, such that a pair of check valve assemblies can be inserted into said valve body through said access opening and urged one against one valve seat surface and the other against the other valve seat surface by a common compression means acting in opposite directions against said valve assemblies, said body member defining a pair of shutoff valve housings, one on each of the opposite sides of said pair of check valve seats.

2. The valve body of claim 1 wherein the total length of the single unitary body member corresponds to the combined lengths of the separate body members of a pair of gate valves and a single check valve in which the separate body members have the same flow diameters as said single unitary body member when the separate check valve and pair of gate valves are interconnected.

3. The valve body of claim 1 wherein each seat surface comprises a surface of the single unitary body member.

4. The valve body of claim 1 wherein said unitary valve body member defines said seat surfaces and said seat surfaces include annular shoulders facing one another on opposite sides of said access opening.

5. The valve body of claim 1 in which the single unitary body member has a removable cover plate for the single access opening and removable shutoff valve caps for attachment to said shutoff valve housings.

6. The valve body of claim 1 including a first shutoff valve mounted within said first shutoff valve housing, a second shutoff valve mounted within said second shutoff valve housing, a first check valve assembly seated against said first valve seat surface, a second check valve assembly seated against said second valve seat surface, both said check valve assemblies opening in a direction to permit flow from said inlet opening to said outlet opening of the unitary valve body.

7. The valve body of claim 6 including a common compression means accessible through said access opening and acting in opposite directions against said check valve assemblies to maintain said assemblies in operating position against said valve seat surfaces within said unitary valve body member.

8. The valve body of claim 7 wherein each check valve assembly comprises a cage member stationarily mounted within said unitary body member, said cage member including a peripheral cage ring seated against one of said annular valve seat surfaces, a central cage cylinder, cage arms interconnecting the cylinder and ring, a guide member connected to and radiating from the cylinder, a piston movable within the cylinder from a closed end of the cylinder, a piston rod connected to the piston and movable through an opposite end of the cylinder, a closure spring means within the cylinder urging the piston toward the closed end, a cup-like closure member in surrounding relationship to the cage cylinder and guide member and having an annular rim at an open end thereof for sealing engagement with the cage ring in a closed position of the closure member and an opposite end wall overlying the opposite end of the cylinder, the opposite end wall being connected to the piston rod such that the closure spring urges the closure member in one direction toward the closed position against fluid pressure acting against the closure member in the opposite direction.

9. The valve body of claim 8 wherein a peripheral edge of the guide member is in fluid-sealing engagement with an inside wall portion of the closure member in the closed position of the closure member, said inside wall portion defining an annular pressure surface against which upstream fluid pressure can act in the closed position of the closure member to open the closure member when there is a predetermined fluid pressure differential across the closure member.

* * * * *